US010601122B2

(12) United States Patent
Hardman et al.

(10) Patent No.: US 10,601,122 B2
(45) Date of Patent: Mar. 24, 2020

(54) S-BAND ANTENNA

(71) Applicant: Astro Digital US Inc., Moffat Field, CA (US)

(72) Inventors: Gordon Hardman, Longmont, CO (US); Mike Patton, San Luis Obispo, CA (US); Jan King, Doonan (AU)

(73) Assignee: Astro Digital US Inc., Moffat Field, CA (US)

( * ) Notice: Subject to any disclaimer, the term of this patent is extended or adjusted under 35 U.S.C. 154(b) by 14 days.

(21) Appl. No.: 15/995,720

(22) Filed: Jun. 1, 2018

(65) Prior Publication Data

US 2019/0372207 A1 Dec. 5, 2019

(51) Int. Cl.

| | |
|---|---|
| ***H01Q 1/28*** | (2006.01) |
| ***H01Q 9/04*** | (2006.01) |
| ***H01Q 1/42*** | (2006.01) |

(52) U.S. Cl.

CPC ..... *H01Q 1/288* (2013.01); *H01Q 1/42* (2013.01); *H01Q 9/0407* (2013.01)

(58) Field of Classification Search

CPC ..... H01Q 1/288; H01Q 1/42; H01Q 9/0407

See application file for complete search history.

(56) References Cited

U.S. PATENT DOCUMENTS

| | | | | |
|---|---|---|---|---|
| 8,102,325 | B2 * | 1/2012 | Feller | H01Q 1/42 343/757 |
| 2012/0154585 | A1 * | 6/2012 | Miranda | B64G 1/1021 348/E7.085 |
| 2014/0247194 | A1 * | 9/2014 | Durnan | H01Q 7/00 343/867 |
| 2015/0071137 | A1 * | 3/2015 | Thiam | H01Q 9/0407 370/297 |
| 2019/0020713 | A1 * | 1/2019 | Hulick | H01Q 1/243 |

* cited by examiner

*Primary Examiner* — Hoang V Nguyen
*Assistant Examiner* — Awat M Salih
(74) *Attorney, Agent, or Firm* — Rowan TELS LLC

(57) ABSTRACT

An antenna includes a body support structure, an extruding mechanism to exert an extrusion force, an extrusion plate to inhibit motion of an extension plate, an extrusion support structure, a nadir panel including one or more communication patches; one or more petals including one or more additional communication patches, one or more extension arms, and an extension mechanism exert an extension force upon the extension plate. The relative position and orientation of the components are altered by the operation of the extension mechanism and the extension mechanism from a stowed state to an extruded state to an extended state. A control system may be included to initiate and control the state of the antenna as well as operate the communications of the antenna once deployed.

15 Claims, 9 Drawing Sheets

S-BAND ANTENNA

BACKGROUND

Communications satellites are artificial structures that relay and in some cases amplify telecommunications signals. They create a communication channel between a source transmitter and a receiver at different ground-based location, such as locations on Earth. Communications satellites may be utilized for television, telephone, radio, internet, and military applications. Wireless communication utilizes electromagnetic waves to carry signals. These waves require line-of-sight, and are thus obstructed by the curvature of the Earth, or other objects. The purpose of communications satellites is to relay the signal around the curve of the Earth, or other objects, allowing communication between widely separated points. Communications satellites may be carried into orbit by a carrier craft. Storage space aboard these craft may be expensive. Thus, a design that minimizes the volume of the satellite may reduce costs.

BRIEF SUMMARY

The disclosed apparatus utilizes mechanisms to alter the state of a satellite from a compact stowed state to a communications-ready extended state. The mechanisms may include motor-driven and potential energy-driven mechanisms to enable different levels of control over the extrusion and expansion of the communications array from within the body of the satellite. The satellite is further designed such that in the extended state, the petals comprising the communication patches are oriented to maximize communicability of signals with Earth-based terminals.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
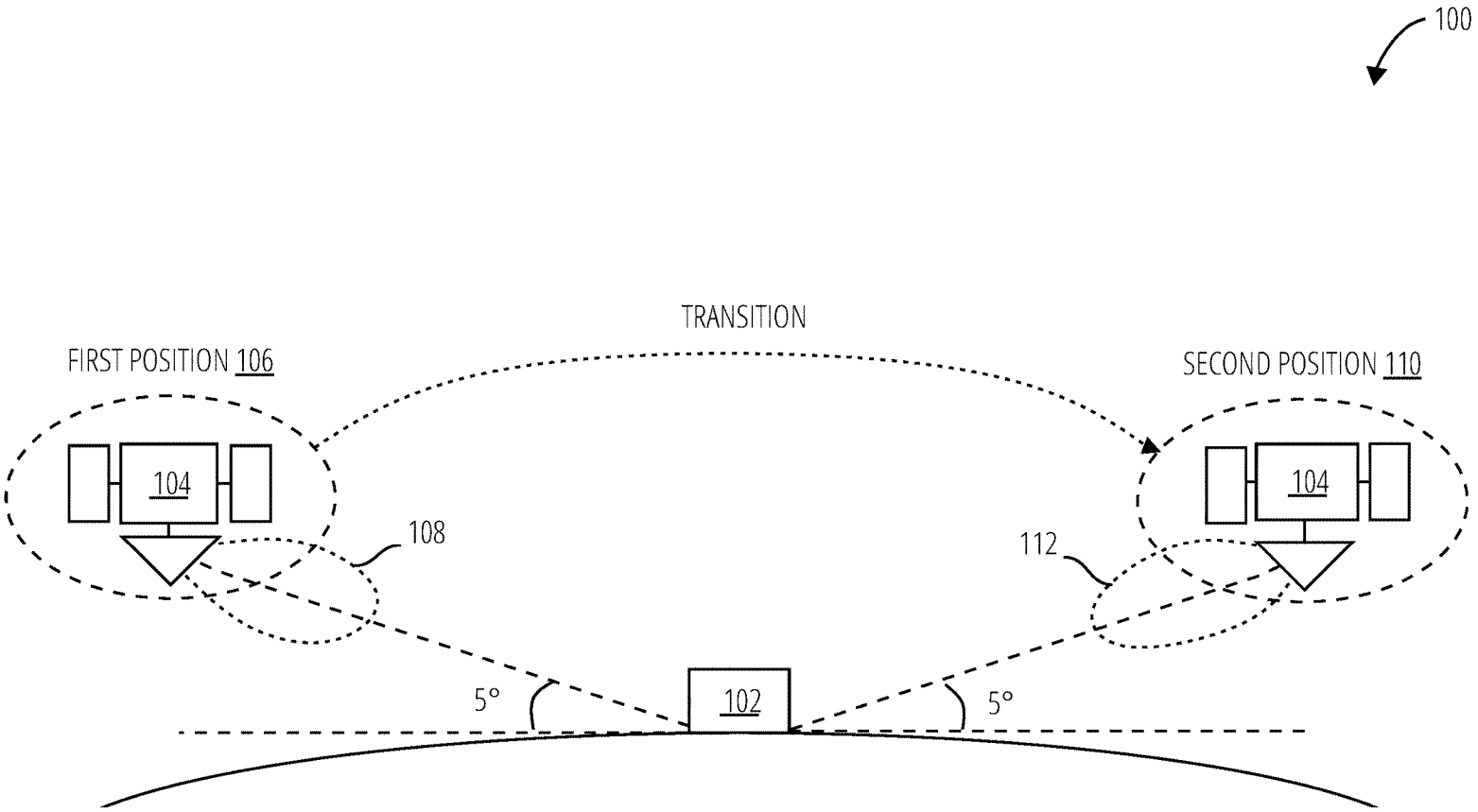
FIG. 1 illustrates an embodiment of a communications environment 100.
Figure 2:
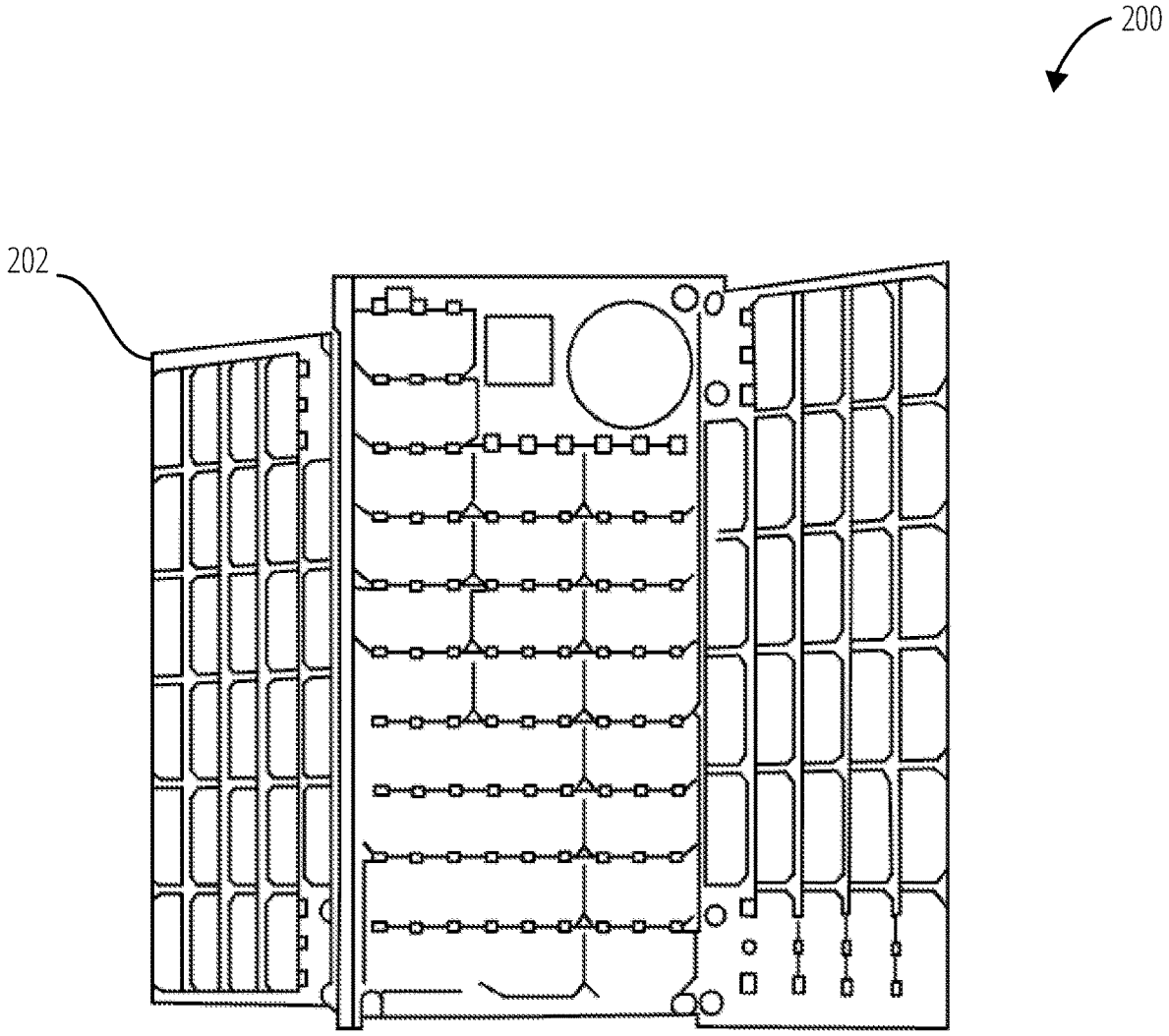
FIG. 2 illustrates an embodiment of a satellite 200 in a stowed state.
Figure 3:
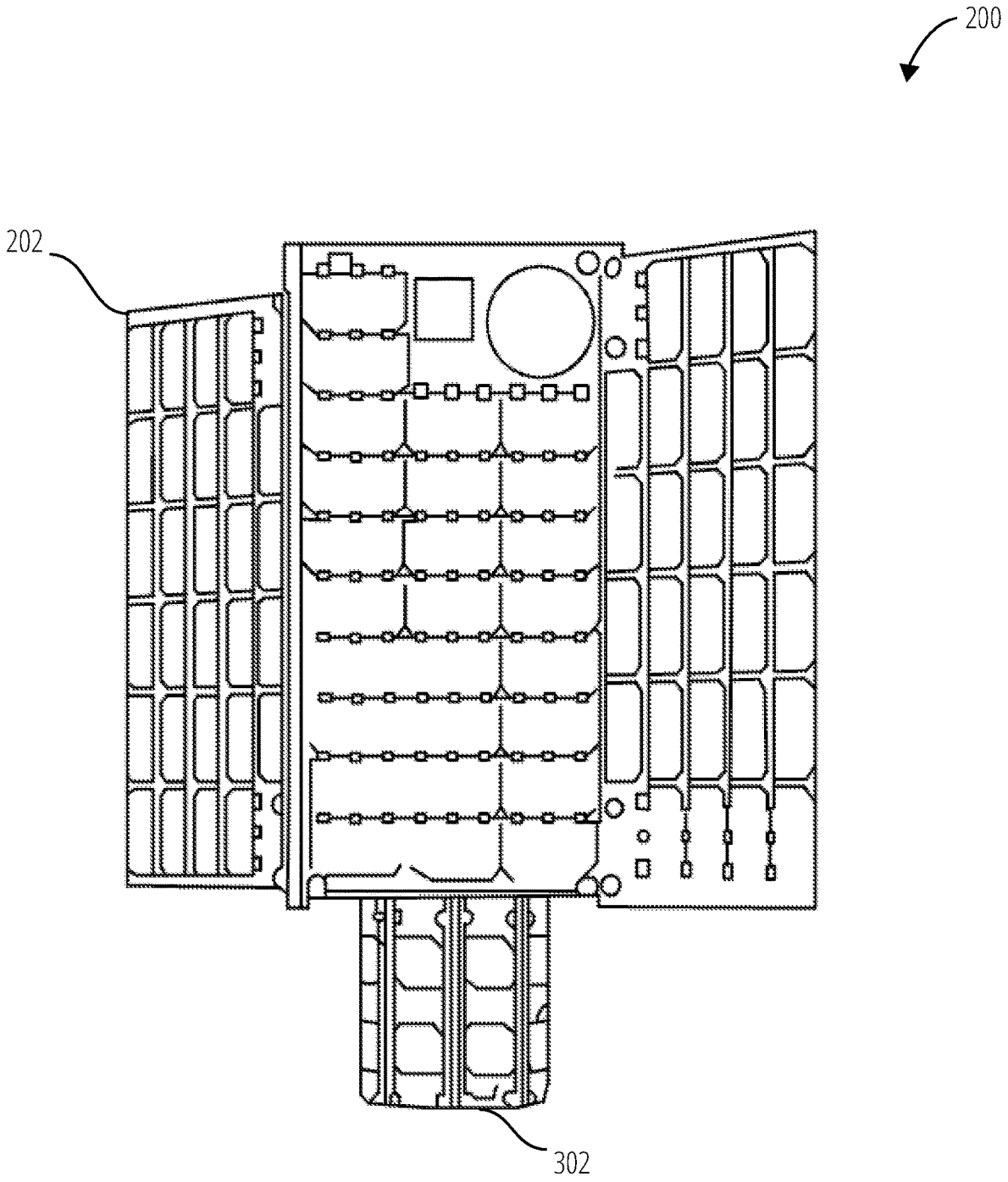
FIG. 3 illustrates an embodiment of a satellite 200 in a partially extruded state.

Referring to FIG. 1, a communications environment 100 comprises a ground terminal 102, a satellite 104, a first position 106, a first beam 108, a second position 110, and a second beam 112.

The ground terminal 102 sends and receives communication signals to and from one or more satellites, including the satellite 104. The ground terminal 102 may operate utilizing various horizon-to-horizon coverages, including a 5° coverage or 10° coverage.

The satellite 104 sends and receives communication signals from one or more ground terminals, including the ground terminal 102. The satellite 104 may be located in multiple positions relatives to the ground terminal 102, such as the first position 106 and the first beam second position 110. The satellite 104 may also have a differing position relative to another ground terminal. The satellite 104 has the first beam 108 while in the first position 106. For example, the satellite 104 may be utilizing the first petal to receive a communications signal from the ground terminal 102 and a second petal to transmit to the ground terminal 102 while located at the first position 106. After transitioning to the second position 110, the satellite 104 may have the second beam 112 and utilize the third petal to receive a communications signal from the ground terminal 102 and the fourth petal to transmit to the ground terminal 102, as the first and second petals are now oriented away from the ground terminal 102. The first beam 108 and the second beam 112 may further be affected by the angle of the petal relative to the nadir, the number and size of patches on each petal, and the materials utilized for the patches and petals.

The satellite 104 may have a control system to determine which petals to utilize to communicate with the ground terminal 102 and other ground terminals.

Referring to FIG. 2-FIG. 6, a satellite 200 is depicted in multiple states and comprises a body 202, an antenna 302, and an antenna extension assembly 502. The satellite 200 may have three states: a stowed state, an extruded state, and an extended state, and transitions between those states. In some embodiments, the satellite 200 may transition between the states multiple time as determined by a control system aboard the satellite 200. In other embodiments, the satellite 200 transitions from the stowed state, through the extruded state, to the extended state once per the control system.

The satellite 200 may be stored in the stowed state (FIG. 2) to be launched into orbit by a carrier craft. While in the stowed state, the antenna 302 and the antenna extension assembly 502 are stored within the body 202 of the satellite 200. The body 202 of the satellite 200 may be hollow to store the antenna 302 and the antenna extension assembly 502. The antenna 302 does not extend past the body 202 of the satellite 200. This enables the satellite 200 to minimize the volume when stored on a carrier craft. The satellite 200 may further have panels on the body 202 that may be deployed and folded to minimize the volume on a carrier craft. The antenna 302 may be deployed before, along with, or after the panels. For example, a control system may detect that the panels have been deployed and, in response, initiate the deployment of the antenna 302.

Figure 4:
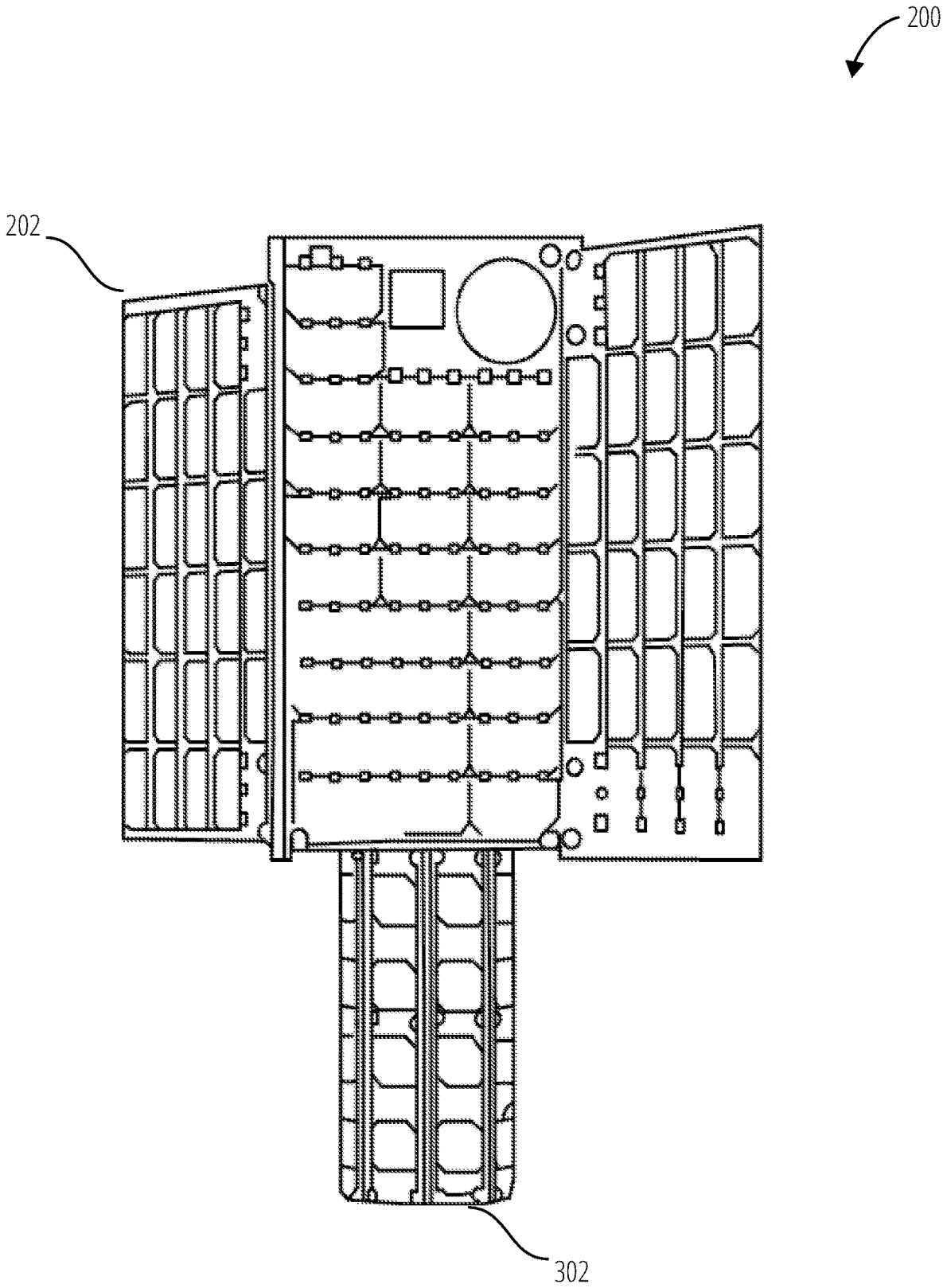
FIG. 4 illustrates an embodiment of a satellite 200 in an extruded state.
Figure 5:
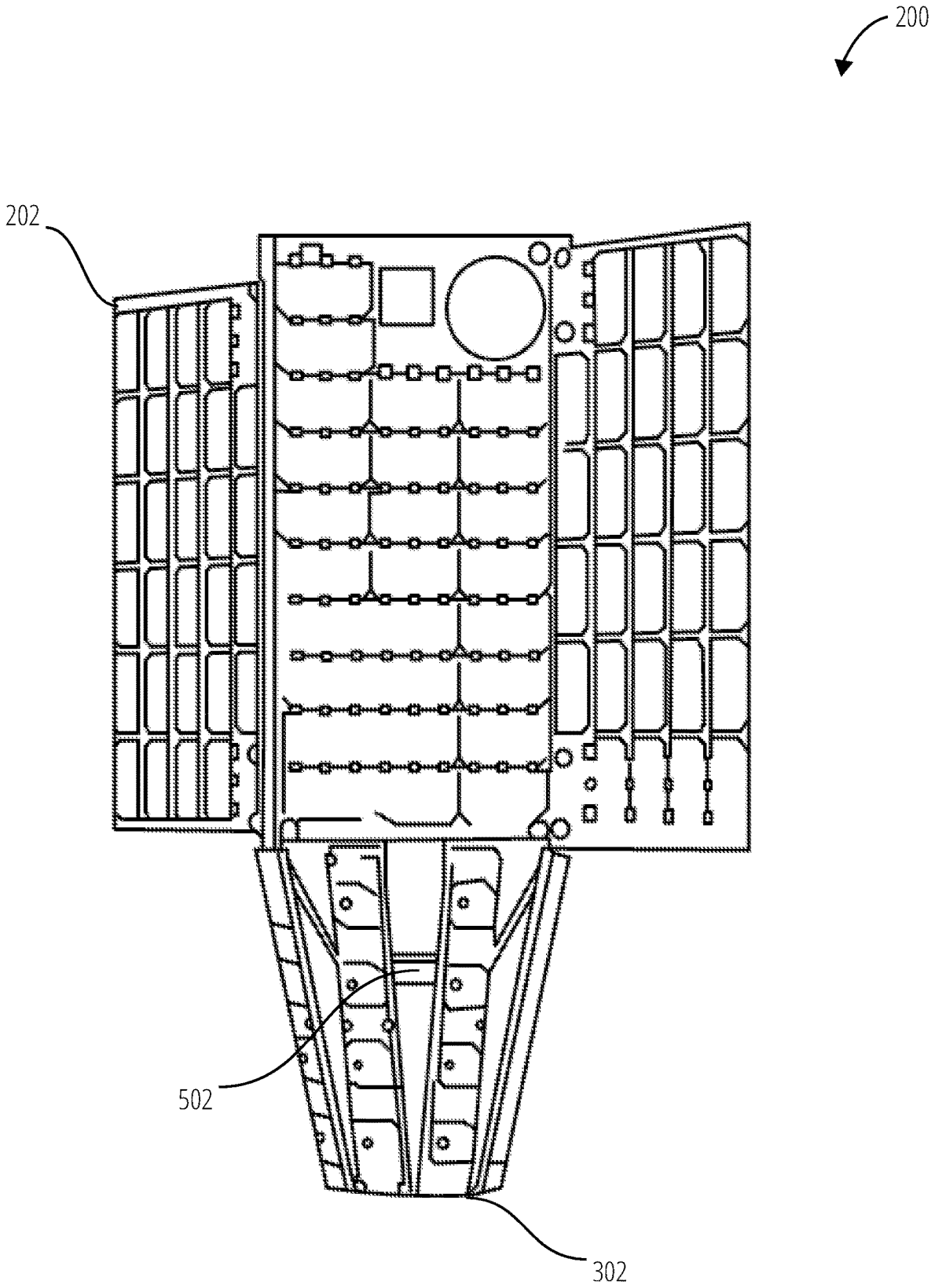
FIG. 5 illustrates an embodiment of a satellite 200 in a partially extended state.

After the deployment of the antenna 302 is initiated, the antenna 302 transitions (FIG. 3) to the extruded state (FIG. 4). The antenna 302 is moved relative to the body 202 of the satellite 200. The transition to the extruded state may be performed through the operation of a motor-driven device or a stored-energy device, such as a spring. The motor-driven method may enable the speed of deployment to be controllable. For example, a motor turning a threaded rod or screw to drive the antenna 302 out of the body 202 of the satellite 200 may control the rate of the rotation of the threaded rod or screw. Further, a control system may determine when the extruded state has been reached by the number of turns of the screw or rod mechanism. The system may then perform the transition to the extended state. For a stored potential method, a latch, or other mechanism, may hold the antenna 302 in place, and release the antenna 302 by the action of the control system.

Figure 6:
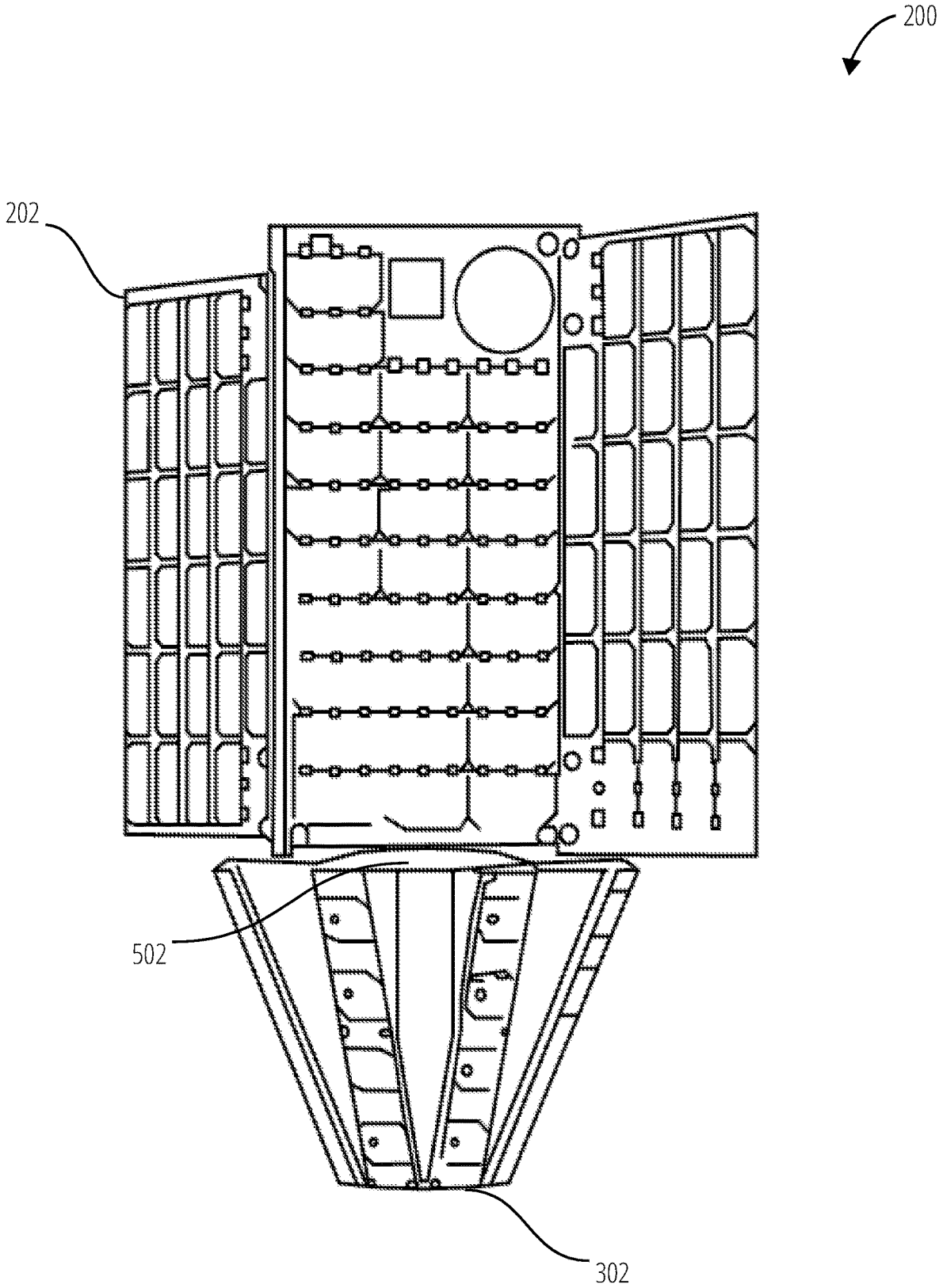
FIG. 6 illustrates an embodiment of a satellite 200 in an extended state.

Once the satellite 200 is in the extruded state (FIG. 4), the satellite 200 may transition (FIG. 5) to the extended state (FIG. 6). A further motor or potential energy system may be utilized. The extension system moves the antenna extension assembly 502 back toward the body 202 of the satellite 200. The antenna extension assembly 502 then operates to extend the petals of the antenna 302 when the antenna extension assembly 502 is moved toward the body 202 of the satellite 200. In one embodiment, a spring is coiled and exerting a spring force upon the antenna extension assembly 502, being held in place by a latch. Once the extruded state is reached, the latch is operated, thereby releasing the spring. The spring drives the antenna extension assembly 502 toward the body 202 of the satellite 200. The antenna extension assembly 502 then extends the petals of the antenna 302. The antenna extension assembly 502 may further come to rest against additional structure of the satellite 200.

In some embodiments, the satellite 200 does not reach a full extruded state prior to the transition to the extended state being initiated. The control system may at a point of partial extrusion, initiate the extension of the antenna 302 by the antenna extension assembly 502. In another embodiment, as the antenna 302 reaches a partially extruded state, a mechanical device, such as a latch may be operated by the movement of the antenna 302 in the extrusion transition to initiate the extension transition.

Figure 7:
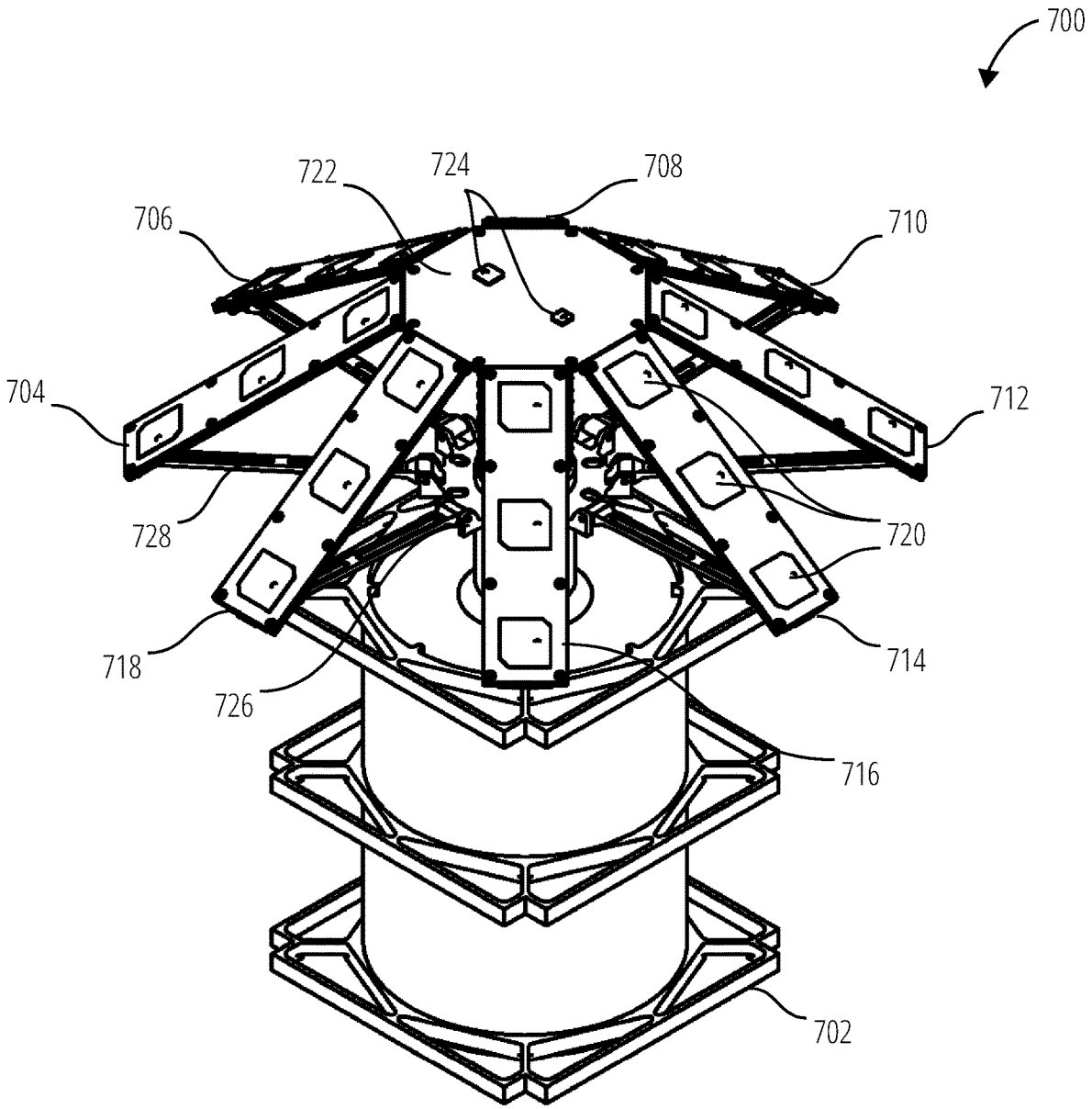
FIG. 7 illustrates a perspective view of an embodiment of an antenna 700.

Referring to FIG. 7, an antenna 700 comprises a support structure 702, a petal 704-petal 718, S-band patches 720, a nadir panel 722, C-band patches 724, an extension plate 726, and an extension arm 728.

The support structure 702 is coupled to the body of the satellite. The support structure 702 may be attached with fasteners, welds, etc., may be press fit into the body of the satellite, or may have components that fit into grooves of the body of the satellite. The support structure 702 may be further coupled to other components of the antenna 700 to ensure the satellite remains integrated.

The petal 704-petal 718 are coupled to the nadir panel 722 and each to one extension arm 728. The petal 704-petal 718 may be rotatably coupled to each of the nadir panel 722 and the extension arm 728. As the extension plate 726 is moved toward the support structure 702 during the extension phase, force is exerted on each petal via the extension arm 728. The force is then applied to each rotatable joint causing each of the petals to align at a specified angle to the nadir panel 722 once the extension plate 726 has come to rest, e.g. between 5 and 45 degrees. The angle at which each of the petals is maintained contributes to the communication profile of the beams sent and received. As depicted in FIG. 7, the antenna 700 comprises eight (8) petals. In other embodiments, a different umber of petals is utilized, such as six (6) petals. In many embodiments, the number of petals is an even number as the petals are grouped as send and receive pairs of petals. A send petal may have neighboring petals that are receive petals (and vice versa) to help ensure that a send petal and a receive petal is oriented toward a ground station. As the number of petals decreases, the antenna 700 is less likely to have an orientation to communicate with a ground station. Increasing the number of petals may increase the size of the antenna 700 (to maintain the same petal size) or decrease the size of each petal. Decreasing the size of each petal may then result in a reduced size of the S-band patches 720, which alters the beam profile for communication. The petal 704-petal 718 each are coupled to one or more S-band patches 720. The S-band patches 720 may be integrated into each of the petals, may be fastened to the petals, etc. As depicted, the antenna 700 has three (3) S-band patches 720 per petal. In some embodiments, each petal may have as few as one (1) patch or as many as eight (8) or more patches. Each of the petals (and patches) may be electrically coupled to a control system of the satellite. When a communication signal is received by a receive petal, the communication signal may be sent to the control system. The control system may then determine the destination of a send signal, select one of the send petals to send the signal, and send the communication signal to the selected send petal to emit the communication signal as part of its beam.

The nadir panel 722 is coupled to the support structure 702 and rotatably coupled to each of the petals. The nadir panel 722 may be coupled to the support structure 702 via intermediary structures (see FIG. 8). The nadir panel 722 may also be coupled to, or contact, an extension mechanism. Such an extension mechanism may also contact or be coupled to the extension plate 726. During the extension phase, the extension mechanism may operate to apply a force to each of the nadir panel 722 and the extension plate 726, causing those components to move away from each other. The nadir panel 722 is coupled to C-band patches 724. The C-band patches 724 may be integrated or fastened to the nadir panel 722. In some embodiments, two (2) C-band patches 724 are coupled to the nadir panel 722. One of the C-band patches 724 may be a send patch, while the other may be a receive patch. Each patch may be wired to a control system of the satellite. During operation, the nadir panel 722 is generally oriented toward the nadir.

The extension plate 726 is rotatably coupled to each extension arm 728. The extension plate 726 may also be slidably coupled to the support structure 702 or intermediary components (see FIG. 8). The extension plate 726 is further coupled or contacted to an extension mechanism. The extension mechanism, when activated, moves the extension plate 726 toward the support structure 702 and away from the nadir panel 722. The extension plate 726 exerts a force on each extension arm 728 via the rotatable coupling.

The extension arm 728 may be rotatably coupled to the extension plate 726 and one of the petals (as depicted, petal 704). In some embodiments, one extension arm 728 is coupled to one petal. In other embodiments, each extension arm 728 may be rotatably coupled to multiple petals. For example the extension arm 728 may be coupled to both petal 704 and the petal 706, resulting in an extension arm 728 with a Y-shape.

Figure 8:
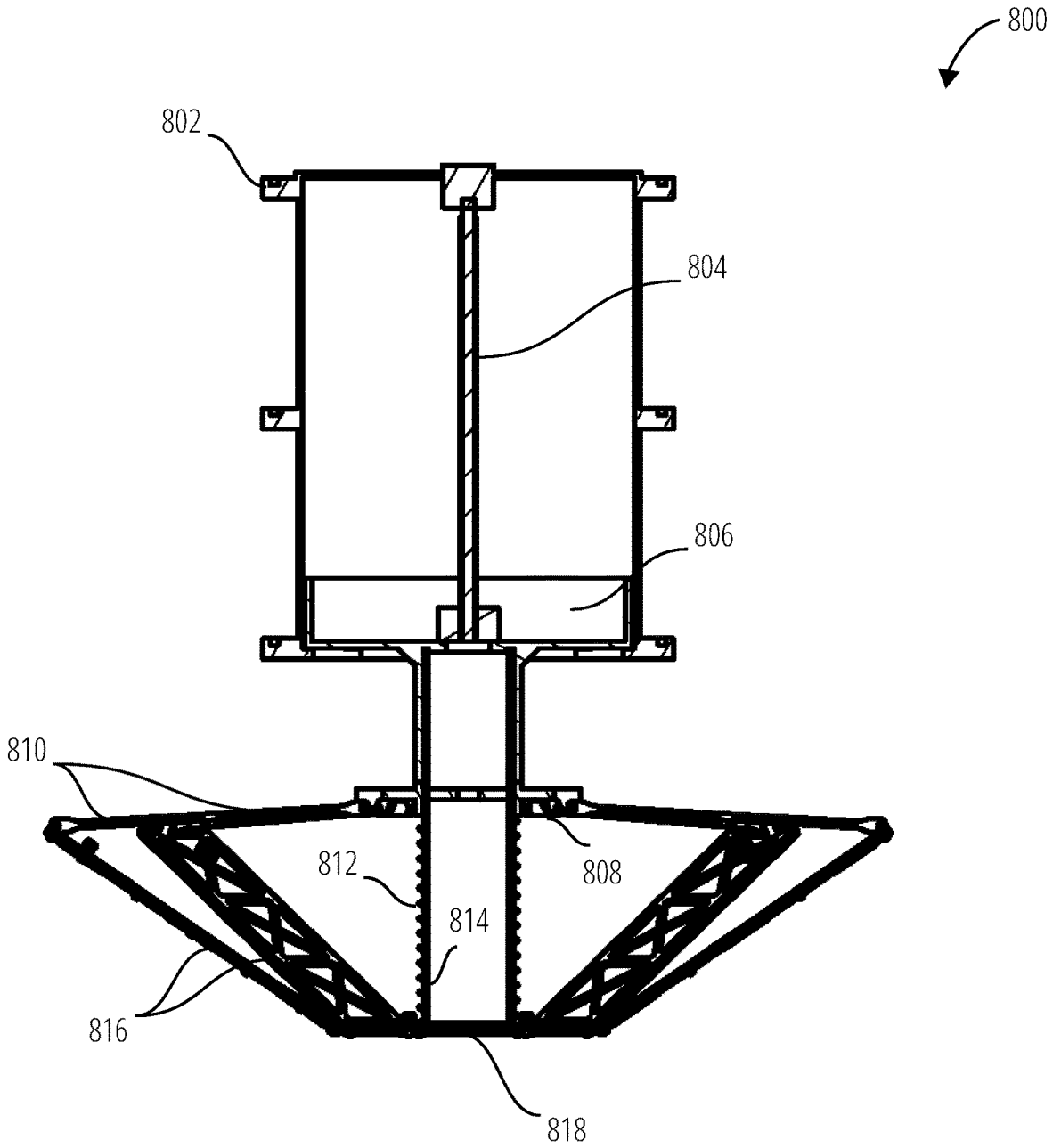
FIG. 8 illustrates a sectional view of an embodiment of an antenna 800.
Figure 9:
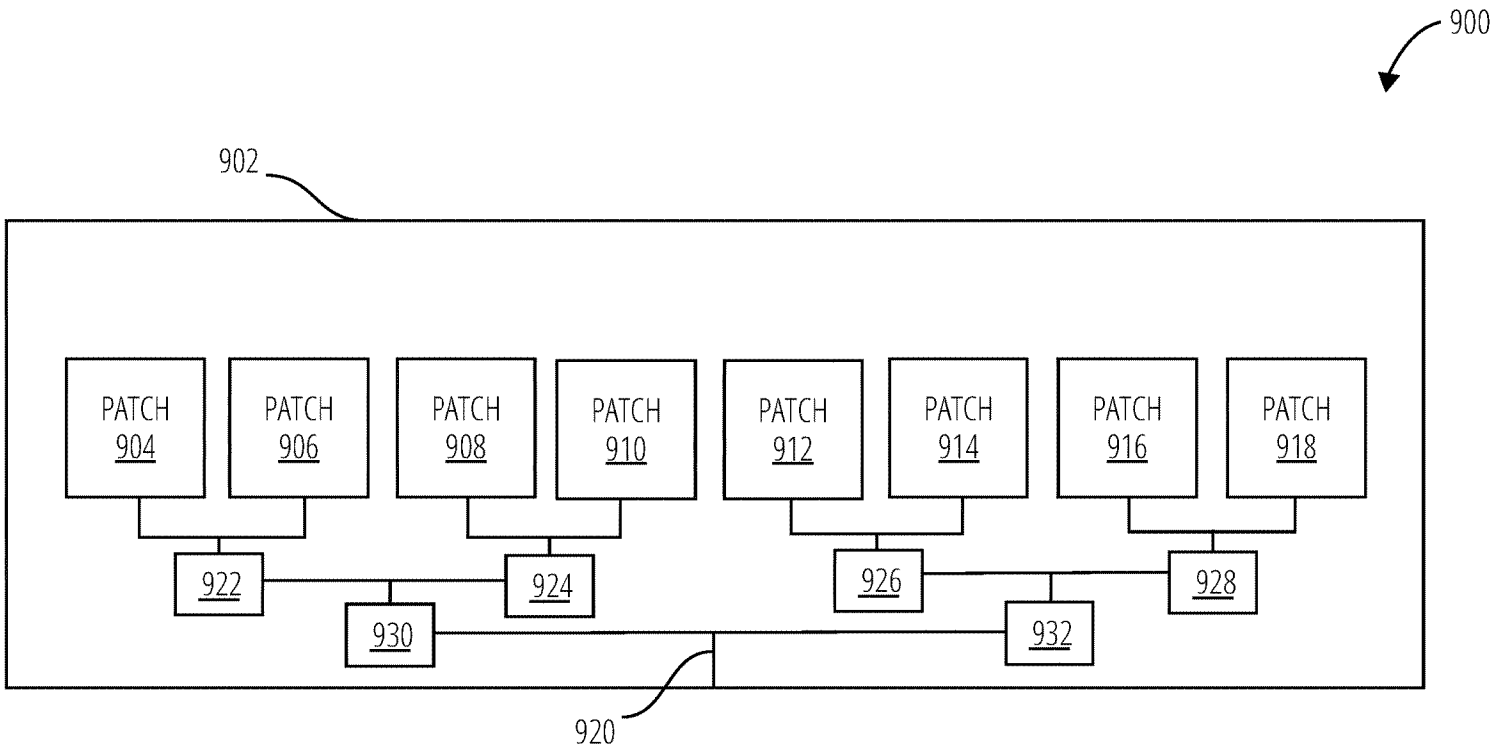
FIG. 9 illustrates a corporate wiring feed 900 of a communications petal.

Referring to FIG. 8, an antenna 800 comprises a body support structure 802, an extruding mechanism 804, an extrusion plate 806, an extension plate 808, extension arms 810, an extension mechanism 812, an extrusion support structure 814, petals 816, and a nadir panel 818.

The body support structure 802 is coupled to the body of the satellite. The body support structure 802 is also coupled to the extruding mechanism 804. The body support structure 802 may be a hollow housing, such that, when the antenna 800 is in the stowed state, the other components are contained within the body support structure 802. The body support structure 802 may further be slidably coupled to the extrusion plate 806. The body support structure 802 may have a hollow cylindrical portion with an inner diameter that is similar to the outer diameter of a portion of the extrusion plate 806 to enable the slidable coupling. The body support structure 802 may be configured such that the extrusion plate 806 may come to rest on part of the body support structure 802 while in the stowed state (top of the body support structure 802 in FIG. 8) or in the extruded or expanded state (bottom of the body support structure 802 in FIG. 8). For example, the bottom of the body support structure 802 may have a notch that impedes the extrusion plate 806 from extending past due to a force from the extruding mechanism 804.

The extruding mechanism 804 is a motor-driven or potential energy-driven mechanism. An exemplary potential energy-driven mechanism is a spring. The extruding mechanism 804 is coupled to the body support structure 802 and the extrusion plate 806. When activated, such as operating the motor to drive a threaded rod or screw or operating a latch to release a spring, the extruding mechanism 804 moves the extrusion plate 806 from the top portion of the body support structure 802 to the bottom portion of the body support structure 802 (as depicted in FIG. 8). The extruding mechanism 804 exerts an extrusion force on the extrusion plate. In embodiments utilizing a motor, the motor may be attached to the body support structure 802. The motor may rotate a threaded rod, or other screw-like structure, and the extrusion plate 806 may have opposing threads, such that as the threaded rod turns by operation of the motor through a control system, the extrusion plate 806 is translated. In embodiments utilizing a spring, the extruding mechanism 804 may be a spring coiled around a rod or similar device. The rod of extruding mechanism 804 may then be slidably coupled to the extrusion plate 806 to guide the extrusion plate 806 during movement. A latch may retain the extrusion plate 806 at the top portion of the body support structure 802 in the stowed position. The latch may receive a control signal from the control system to operate. The latch may then release, enabling the spring mechanism of the extruding mechanism 804 to move the extrusion plate 806 to the bottom portion of the body support structure 802.

The extrusion plate 806 is coupled to the body support structure 802, the extruding mechanism 804, and the extrusion support structure 814. The extrusion plate 806 may also inhibit further movement of the extension plate 808 when the extension plate 808 is moved toward the extrusion plate 806 during the expansion phase by a receiving surface with a larger diameter than the inner diameter of the extension plate 808. The extension plate 808 may come to rest as it contacts the extrusion plate 806 at the receiving surface, which may be a notch or a lip. The extrusion plate 806 may have two portions. A top portion is slidably coupled to the body support structure 802 and the extruding mechanism 804. The outer diameter of the top portion of the extrusion plate 806 may be a similar size to the inner diameter of a cylindrical portion of the body support structure 802 enabling a slidable coupling. The extrusion plate 806 may have an inner diameter that is similar in size either to the outer diameter of screw mechanism or the rod of the extruding mechanism 804. In embodiments utilizing the screw mechanism, the inner diameter of the extrusion plate 806 may be threaded to engage the screw mechanism. The top portion of extrusion plate 806 may rest against the body support structure 802 when fully extruded. The bottom portion is coupled to the extrusion support structure 814. The bottom portion may be a hollow cylinder attached to the top portion on one end and have a lip (i.e., area with a larger diameter) or a notch (i.e., area with a smaller diameter) at the other end, which acts as a receiving surface for the extension plate 808. The inner diameter of the bottom portion of the extrusion plate 806 may be attached to the extrusion support structure 814, for example, by a friction fit, welds, etc. The lip of the bottom portion of the extrusion plate 806 contacts the extension plate 808 and inhibits the extension plate 808 from moving closer to the body support structure 802 when under the force of the extension mechanism 812 in the extended state. The length of the bottom portion of the extrusion plate 806 combined with the length of the extrusion support structure 814 are utilized to alter the angle of the petals 816 while in the extended state.

The extension plate 808 is coupled to the extension arms 810 and the extrusion support structure 814. The extension plate 808 may contact and come to rest against the extrusion plate 806 in the extended state. The extension plate 808 may also contact, be coupled to, or be affixed to the extension mechanism 812. The extension plate 808 receives a force from the extension mechanism 812 to be moved away from the nadir panel 818 during the extension phase. The extension plate 808 move a distance away from the nadir panel 818 due to the extension force and the contact with the extrusion plate 806. The extension plate 808 may be rotatably coupled to the extension arms 810. As the extension plate 808 is moved by the action of the extension mechanism 812, part of the force is directed through the couplings to the extension arms 810. The extension plate 808 may slidably engage the extrusion support structure 814 such that the extrusion support structure 814 guides the extension plate 808 as it moves away from the nadir panel 818 to the extrusion plate 806.

The extension arms 810 are rotatably coupled to the extension plate 808 and the petals 816. In some embodiments, one of the extension arms 810 is coupled to one of the petals 816 and the extension plate 808. In other embodiments, one of the extension arms 810 is coupled to two or more of the petals 816. During the extension phase, each of the extension arms 810 receive a force from the rotation couplings to the extension plate 808. The force is directed through each of the extension arms 810 to each of the petals 816. The translated force from the extension plate 808 additionally re-orients each of the extension arms 810. The extension arms 810 may begin the extension phase at a smaller angle relative to the extrusion support structure 814 than at the end of the extension phase. For example, the extension arms 810 may begin at 5° and end at 90° relative to the extrusion support structure 814. The length of the extension arms 810 helps determine the resting angle. The location of the extension plate 808 may determine the resting angle of the extension arms 810 in the extended state.

The extension mechanism 812 is coupled to the extension plate 808 and the nadir panel 818. The extension mechanism 812 may further contact the extrusion support structure 814. For example, the extension mechanism 812 may be a spring coiled around the extrusion support structure 814. The extension mechanism 812 may be affixed to either or both of the extension plate 808 and the nadir panel 818. In other embodiments, the extension mechanism 812 may also contact the extension plate 808 and the nadir panel 818. The extension mechanism 812 may be a potential energy-driven mechanism, such as a spring, or a motor-driven mechanism, such as a motor and a screw. A spring-driven mechanism may further have a latch to inhibit the expansion of the spring. The motor or latch may be operated by a control system. When activated, the extension mechanism 812 applies a force to the extension plate 808 and the nadir panel 818, which effects a movement of the extension plate 808 away from the nadir panel 818. The extension mechanism 812 may move the extension plate 808 until the extension plate 808 comes to rest against the extension plate 808.

The extrusion support structure 814 is coupled to the extrusion plate 806 and the nadir panel 818. The extrusion support structure 814 may further be slidably coupled or contacting the extension plate 808 and the extension mechanism 812. The extrusion support structure 814 may have an outer diameter of similar size to the inner diameter of the extrusion plate 806 enabling a friction fit. The extrusion support structure 814 may also be weld, fastened, etc. to the extrusion plate 806. The extrusion support structure 814 may be fastened, welded, etc. to the nadir panel 818. The nadir panel 818 may also have an annular structure with a diameter similar to the outer diameter to the extrusion support structure 814 to enable a friction fit between the extrusion support structure 814 and the nadir panel 818. During the extrusion phase, the extrusion support structure 814 may receive a force from the extrusion plate 806 and transfer the force to the nadir panel 818 thereby moving the nadir panel 818, and thus the petals 816, the extension arms 810, and the extension plate 808. The extrusion support structure 814 may further comprise a latch mechanism to inhibit movement of the extension plate 808 until operated by a control system.

The petals 816 are rotatably coupled to the extension arms 810 and the nadir panel 818. The petals 816 may comprise patches to enable communication signals to be sent and received. During the extrusion phase, the petals 816 are moved away from the body support structure 802 by the extruding mechanism 804 through the extrusion plate 806, the extrusion support structure 814, and the nadir panel 818. During the extension phase, the petals 816 receive a force from the extension arms 810. The force is directed to rotating the petals 816 to a specific angle in the extended state. The length of the petals 816 helps determine the resting angle in the extended state, which determines the communication profile of the satellite.

The nadir panel 818 is coupled to the extrusion support structure 814 and rotatably coupled to each of the petals 816. The nadir panel 818 may further comprise patches and is oriented toward the nadir during operation. The nadir panel 818 is moved away from the body support structure 802 during the extrusion phase and remains stationary during the extension phase, applying a force to the extrusion support structure 814 when the extrusion support structure 814 is activated, to help move the extension plate 808 toward the body support structure 802.

The corporate wiring feed 900 comprises a petal 902, a patch 904-patch 918, transmission lines 920, and an impedance transformer 922-impedance transformer 932.

The petal 902 may be attached to a satellite and deployed in orbit to enable communication between ground terminals. The petal 902 may comprise one or more ground planes, a dielectric material, one or more patches (such as patch 904-patch 918), and transmission lines (such as the transmission lines 920). The ground planes may be a conduction metal. In one embodiment, ground plane is copper. The dielectric material is then deposited on the ground plane. The patches and transmission lines may be printed into the substrate during the deposition. The dielectric material may be air (with mounts connecting the ground layer and patches), fiberglass, polychlorinated biphenyl, styrofoams, aerogel, etc. The material used as the dielectric material may have differing dielectric constants. The petal 902 may have a dielectric material with a dielectric constant ranging from one (1) to three (3). The dielectric constant affects the performance of the antenna. For example, a lower dielectric constant may broaden the bandwidth of the petal 902. However, a higher dielectric constant, while narrowing the bandwidth may enable the utilization of smaller or thinner patches. Thus, more patches may be utilized or the size of the petal 902 may be reduced.

The patch 904-patch 918 may be printed into the petal 902 or may be attached to the petal 902. Each patch may be a conductive metal. For example, each patch may be copper. The patches may further operate at 50 ohms. The signals to the patches (for send petals) or signals from the patches (for receive petals) may be send over the transmission lines 920. The transmission lines 920 may be electrically coupled to a control system. The patches may be oriented to send or receive signals at the same amplitude and phase. In some embodiments, the patches are oriented such that the normal direction to the patch while the satellite orbits the Earth corresponds to a point on the Earth to enable peak gain.

The transmission lines 920 electrically couple the patches to the control system of the satellite. The transmission lines 920 may be a parallel feed, or another feed system, such as the corporate feed depicted. The transmission lines 920 may be constructed as to ensure the length of the feed from each patch is of the same length. While each patch may operate at a specific resistance (e.g., 50 ohms), combining the feeds from each patch may reduce such resistance (e.g., for eight patches in parallel, 6.25 ohms). The transmission lines 920 thus may utilize the impedance transformer 922-impedance transformer 932 after each joint to increase the resistance of the signal from the junction.

Terms herein should be accorded their ordinary meaning in the arts unless otherwise indicated expressly or by context:

"Angle" herein refers to the supplementary angle to the angle of the rotational joint between the nadir panel and a petal.

"C-band patches" herein refers to material to communicate in the C-Band, the microwave range of frequencies ranging from 4.0 to 8.0 gigahertz (GHz).

"Communication signal" herein refers to information transmitted by electromagnetism.

"Dielectric constant" herein refers to a quantity measuring the ability of a substance to store electrical energy in an electric field.

"Dielectric material" herein refers to a medium or substance that transmits electric force without conduction, such that it acts as an insulator.

"Extension force" herein refers to a mechanical force applied to the antenna to cause the petals to rotate to the designated angle with the nadir plate.

"Extrusion force" herein refers to a force exerted on the antenna to translate multiple components of the antenna from within the body support structure to outside the body support structure.

"Ground terminal" herein refers to a terrestrial radio station designed for extraplanetary telecommunication with the antenna.

"Horizon angle" herein refers to an angle measure from the horizon of the surface of an object from which the ground terminal transmits.

"Impedance transformer" herein refers to an electrical device that transfers electrical energy between two or more circuits through electromagnetic induction to match the impedances of the circuits.

"Motor" herein refers to a machine, which may be powered by electricity or internal combustion, that supplies motive power for a vehicle or for some other device with moving parts.

"One or more communication patches" herein refers to material utilized to send and receive signals utilizing the electromagnetic frequency spectrum.

"Receive petal" herein refers to a petal of a communication array with communication patches configured to receive communication signals.

"S-band patches" herein refers to material to communicate in the S-Band, utilizing the microwave band of the electromagnetic spectrum covering frequencies from 2 to 4 gigahertz (GHz).

"Send petal" herein refers to a petal of a communication array with communication patches configured to send communication signals.

"Transmission lines" herein refers to electrically conductive material utilize to electrically couple communication patches.

What is claimed is:

1. An antenna comprising:

a body support structure:

coupled to an extruding mechanism; and having an inner diameter of the body support structure slidably engaged to an outer diameter of an extrusion plate;

the extruding mechanism:

coupled to the body support structure;

engaged with the extrusion plate; and coupled to exert an extrusion force on the extrusion plate;

the extrusion plate:

having the outer diameter of the extrusion plate slidably engaged with the inner diameter of the body support structure;

engaged with and able to receive the extrusion force from the extruding mechanism;

coupled to an extrusion support structure; and having a receiving surface to inhibit movement of an extension plate;

the extrusion support structure:

coupled to the extrusion plate;

having an outer diameter of the extrusion support structure slidably engaged to an inner diameter of the extension plate; and coupled to a nadir panel;

the nadir panel:

comprising one or more communication patches;

coupled to the extrusion support structure;

rotatably coupled to one or more petals; and able to receive an extension force from an extension mechanism;

the one or more petals:

comprising one or more additional communication patches;

each rotatably coupled to the nadir panel; and each rotatably coupled to one of one or more extension arms;

the one or more extension arms:

each rotatably coupled to one or more of the one or more petals; and each rotatably coupled to the extension plate;

the extension plate:

having the inner diameter of the extension plate slidably engaged to the outer diameter of the extrusion support structure;

rotatably coupled to the one or more extension arms; and coupled to receive the extension force from the extension mechanism; and the extension mechanism to contact and exert the extension force upon the nadir panel and the extension plate; and wherein the extrusion plate, the extrusion support structure, the nadir panel, the one or more petals, the one or more extension arms, the extension plate, and the extension mechanism the extrusion force are stored within the body support structure in a stowed state and the extrusion force moves at least the nadir panel, the one or more petals, the one or more extension arms, the extension plate, and the extension mechanism outside the body support structure to an extruded state; and wherein the extension plate is moved by the extension force to contact a receiving surface of the extrusion plate, the extension plate and the one or more extension arms rotating the one or more petals to an extended state, the one or more petals oriented at an angle relative to the nadir panel based on a distance of the extension plate from the nadir panel in the extended state, a length of the one or more extension arms, and a length of the one or more petals.

2. The antenna of claim 1, wherein the extruding mechanism comprises:

a rod coupled to the body support structure and slidably engaged with the extrusion plate;

a spring between the body support structure and the extrusion plate; and a latch to:

maintain the spring coiled in the stowed state; and operable to release the spring in the extruded state and the extended state.

3. The antenna of claim 1, wherein:

the extruding mechanism comprises:

a threaded rod coupled to the body support structure and engaged with the extrusion plate; and a motor operable to turn the threaded rod to transition from the stowed state to the extruded state; and the extrusion plate comprising opposing threads to the threaded rod.

4. The antenna of claim 1, wherein the one or more communication patches of the nadir panel are C-band patches.

5. The antenna of claim 4, wherein the nadir panel comprises two of the C-band patches, a first one configured to receive communication signals and a second one to send the communication signals.

6. The antenna of claim 1 wherein the one or more additional communication patches of the one or more petals are S-band patches.

7. The antenna of claim 6, wherein each of the one or more petals comprises four of the one or more additional communication patches.

8. The antenna of claim 1, wherein the antenna comprises eight petals, the eight petals grouped into four pairs of petals, each pair having a receive petal and a send petal.

9. The antenna of claim 1, wherein the one or more additional communication patches are combined into a corporate feed.

10. The antenna of claim 1, further comprising a latch, wherein the extension mechanism comprises a spring coiled around the extrusion support structure, the spring contacting the nadir panel and the extension plate and the latch maintaining the spring in coiled in the stowed state and the extruded state and operable to release the spring in the extended state.

11. The antenna of claim 10, wherein the extrusion support structure comprises the latch, the latch extending from the outer diameter of the extrusion support structure to contact the extension plate.

12. The antenna of claim 10, wherein the extension plate comprises the latch, the latch extending into a notch in the extrusion support structure.

13. The antenna of claim 1, wherein an angle of the one or more petals is between 5 and 45 degrees.

14. The antenna of claim 1, wherein the one or more petals comprise a dielectric material with a dielectric constant between 1 and 3.

15. The antenna of claim 1, wherein the antenna is configured to receive communication signals from a ground terminal with a horizon angle ranging from 0 to 10 degrees.

* * * * *